United States Patent [19]

Bowman

[11] Patent Number: 4,834,574

[45] Date of Patent: May 30, 1989

[54] UTILITY COVER EXTENSION

[76] Inventor: Harold M. Bowman, 18867 N. Valley Dr., Fairview Park, Ohio 44126

[21] Appl. No.: 76,668

[22] Filed: Jul. 23, 1987

[51] Int. Cl.[4] ..... E02D 29/14

[52] U.S. Cl. ..... 404/26; 404/72

[58] Field of Search ..... 404/25, 26; 52/19, 20, 52/21; 277/178, 192, 199

[56] References Cited

U.S. PATENT DOCUMENTS

| | | | |
|---|---|---|---|
| 1,987,502 | 1/1935 | Born et al. | 404/25 |
| 1,990,909 | 2/1935 | Lambert | 404/25 X |
| 3,209,663 | 10/1965 | Baier | 292/260 |
| 3,218,943 | 11/1965 | Bowman | 40/26 |
| 3,308,727 | 3/1967 | Hurt, Jr. | 404/25 X |
| 3,858,998 | 1/1975 | Larsson et al. | 404/26 |
| 3,920,347 | 11/1975 | Sauriol et al. | 404/25 |
| 3,926,533 | 12/1975 | Binette | 404/26 |
| 3,930,739 | 1/1976 | Larsson et al. | 404/26 |
| 3,968,600 | 7/1976 | Bowman | 52/19 |
| 3,969,847 | 7/1976 | Campagna et al. | 52/1 |
| 3,973,856 | 8/1976 | Gaglioti | 404/25 |
| 4,029,425 | 6/1977 | Pelsue | 404/25 |
| 4,030,851 | 6/1977 | Graybeal | 404/25 |
| 4,101,236 | 7/1978 | Meyer | 404/25 |
| 4,187,647 | 2/1980 | Hall | 52/20 |
| 4,188,151 | 2/1980 | Hall | 404/26 |
| 4,203,190 | 5/1980 | Temple et al. | 29/451 |
| 4,203,686 | 5/1980 | Bowman | 404/25 |
| 4,236,358 | 12/1980 | Bowman | 52/19 |
| 4,273,467 | 6/1981 | Cronk | 404/26 |
| 4,281,944 | 8/1981 | Bowman | 404/26 |
| 4,582,450 | 4/1986 | Neil | 404/26 |
| 4,648,740 | 3/1987 | Carlson | 52/19 X |
| 4,650,365 | 3/1987 | Runnels | 404/26 X |
| 4,706,718 | 11/1987 | Milo | 404/26 X |

FOREIGN PATENT DOCUMENTS

| | | | |
|---|---|---|---|
| 2102479 | 2/1983 | United Kingdom | 52/20 |

*Primary Examiner*—Thuy M. Bui
*Assistant Examiner*—Matthew Smith
*Attorney, Agent, or Firm*—Watts, Hoffmann, Fisher & Heinke Co.

[57] ABSTRACT

A utility cover extension and its process of installation are shown. The extension is adapted to rest on the cover support flange of and make a snug fit in a utility housing for a manhole cover. The extension provides an access opening above the housing. It has a rim and seat that furnish lateral retention and a new, substantially higher elevation for the cover. The extension has at least one spreadable joint for expanding its periphery against the constraint of the housing, and there is a gap in the seat at the joint when the extension is expanded. A discrete closure comprising compressible polymer is applied at the gap for preventing the substantial infiltration of surface water therethrough.

4 Claims, 5 Drawing Sheets

UTILITY COVER EXTENSION

BACKGROUND OF THE INVENTION

This invention relates to utility cover extensions and more particularly to utility cover extensions for adjusting the level of a utility cover to a new grade.

In the repair and resurfacing of streets and highways, it is frequently found that the repaired or resurfaced roadway is substantially higher than the original roadway. Accordingly, the top surface of the utility covers in the roadway, such as manhole covers, water and gas valve covers, gas and water meter covers and the like, are disposed substantially below the new road surface. This lower position of the utility cover creates a hazardous driving condition. These utility covers must be raised in order to adjust their top surfaces to that of the new level of the roadway.

In the original roadway, the utility cover is positioned over an access opening of a utility housing. The access opening generally has a support flange on which the utility cover is supported with the top surface of the utility cover to the level as the original highway.

One known construction for raising a utility cover to the new grade of the repaired or resurfaced roadway are manhole cover supports used to raise a manhole cover above the manhole housing so that the top of the manhole cover is at the new grade of the roadway. These manhole cover supports are designed to fit into the manhole housing and support the cover so that its top surface is at the new level of the roadway. The use of such manhole cover supports are desirable since it becomes unnecessary to replace the frame which is embedded in a paved road.

When raising the utility cover to a new grade, it is desirable to provide a utility cover support which when assembled with the utility frame and cover resists displacement or dislocation of those components under normal service conditions of the roadway. Under such service conditions various vehicle traffic loadings occur including axle, wheel and impact loadings, and various temperature conditions, such as steam from steam lines, and various chemical conditions, for example, spills of oil or gasoline on the roadway, also occur. If such service conditions create displacement or dislocation of the utility cover extension, utility housing, or cover, a depression or protrusion in the road surface will be realized which creates a driving hazard.

Furthermore, other hazardous driving conditions may be created, for example, when a impact loading is made on one of the components, such as the cover, and the cover pops out of the opening. Accordingly, it is desirable that relative movement between the components be resisted under such service conditions which includes the ability to absorb impact loadings, operate under various temperature conditions and various chemical environments.

It is also desirable to provide a utility cover support which resists rotation of the utility cover which results in wear between the components. For example, after repeatedly impacting the utility cover on one side, the cover tends to rotate thus abrading the surfaces between the cover and the utility support. Such wear creates a looser fit and allows more movement between the cover and the cover support. As the surfaces between the utility cover and utility cover support wear, the likelihood of displacement or dislocation of the cover under normal service conditions is increased which accordingly creates a hazardous driving condition.

It is also desirable to minimize the flow of surface water and other contaminants into the access opening of the utility housing. Water infiltration into the access opening of the utility housing has been a continuous problem with telephone companies, municipal public work departments and other public utility companies. For example, it is desirable to segregate different types of municipal water systems. Large volumes of additional waste water must be treated when surface water infiltrates into a sewer system through a manhole. The overloading of sewage systems has increased in importance from many years ago and the key factor is that today there is significantly less pervious area than there was years ago. This factor is due to larger impervious street surfaces that collect more drainage water as well as smaller building lot sizes which cut down on the amount of overall pervious area. By significantly decreasing the flow of storm and drainage water into the access opening, existing water treatment facilities can handle more sewage capacity.

In the case of electric and gas underground systems, in many instances, continuous pumping of water is required before utility men can enter a manhole because of water infiltration between the manhole cover components. In the case of utility cover assemblies for utility valves, meters and the like, the surface water and other contaminants such as dirt, deteriorate the valve or meter and inhibit its operation and ease of access thereto. It is also desirable to keep contaminants out of the utility frame in the case of gas and water meters to allow for ready access to the gas and water meters and reading thereof and their operation.

It is desirable to provide a utility cover support which reduces noise generated under normal service conditions. It is also desirable to absorb and dissipate the energy exerted on the components of the utility cover support assembly under normal service conditions.

SUMMARY OF THE INVENTION

The present invention provides the above described desireable features with an improved utility cover extension. The utility cover extension of the present invention is provided to be inserted into the access opening of a utility housing for vertically adjusting the level of a utility cover over the access opening to a new grade. The access opening of the utility housing includes a support flange with an upwardly and outwardly sloping peripheral surface extending from the flange. The utility cover has a bottom and an outer peripheral surface extending therefrom. The extension has an assembled and an unassembled condition with the utility cover and housing.

The extension has a bottom portion for insertion into the access opening of the utility housing and an upper portion for receiving the utility cover therein The bottom portion has a bottom support surface positionable adjacent the support flange of the utility housing and a bottom outer peripheral surface extending upwardly from the bottom support surface and upwardly sloping peripheral surface of the utility housing when in an assembled condition.

The upper portion has an upper support surface for supporting the utility cover and an upper inner peripheral surface extending upwardly from the upper support surface and positionable adjacent to and complimentary with the outer peripheral surface of the cover when in the assembled condition. The utility extension includes an extension frame and a compressible material forming at least a portion of the peripheral surfaces of the extension housing. The peripheral surfaces of the extension have a circumference with an interference fit with its complimentary peripheral surface of the utility housing and cover. In an assembled condition, the compressible material is compressed and frictionally engages under compression the utility cover and the utility housing and provides a sealing relationship therebetween.

The present invention provides methods for improving the frictional engagement of a utility cover extension to a utility housing or a utility cover. The present invention also provides methods for improving the seal between the utility cover extension and a utility housing or cover.

The present invention achieves the desired feature of resisting the premature displacement or dislocation of the utility cover extension assembly by increasing the frictional forces between the components of a utility cover extension assembly. By forming the peripheral surfaces of the utility cover extension from a flexible compressible material, the forces exerted on the assembly are absorbed and dissipated and the components of the assembly urged to return to their original position.

In an unassembled condition, and when the cover extension is at its assembled circumferential condition, the complimentary peripheral surfaces of the utility housing, extension and cover have an interference fit. The circumference of the outer peripheral surface of the lower portion of the extension is greater than the circumference of the inner peripheral surface of the utility housing. The upper inner peripheral surface of the upper portion of the utility cover extension is less than the circumference of the utility cover. When the utility cover extension is assembled with the housing, the compressible material is compressed and deforms to the above mentioned circumference of the inner peripheral surface of the frame. When the cover is assembled with the utility cover extension the inner peripheral surface of the upper portion of the extension is deformed and the compressible material compressed to the configuration of the circumference of outer peripheral surface of the cover. In such an assembled relationship the cover assembly provides for the resilient frictional interconnection of the components of the utility cover extension assembly while allowing for resilient movement of the components therebetween to absorb and dissipate impact forces experienced in normal service conditions without losing frictional engagement of the components.

The present invention also provides the desirable feature of resisting infiltration of surface water and other contaminants into the access opening. The compressible material provides for sealing the complimentary peripheral surfaces between the cover and cover extension and also between the cover extension and the frame. This seal is maintained even with slight relative movement of parts of the cover extension assembly since the compressible material flexes and maintains a seal during such movement. In the case of an adjustable cover support, the compressible material is sufficiently flexible to fill the spaces between the segments of the rigid portion of the cover support and maintain continuous contact about the entire periphery of the complimentary peripheral surfaces.

Utility cover extensions of the present invention may have a wide variety of constructions and designs. For example, manhole cover supports may be of solid continuous construction, as cast rings, or adjustable to fit various manhole housing openings. The geometric configurations of utility cover supports may be of a variety of configurations for example, round, square, rectangular or triangular shapes dependent on the shape of the utility housing and frame and may be manufactured by forming, fabricating or casting.

DETAILED DESCRIPTION OF THE INVENTION

Figure 1:
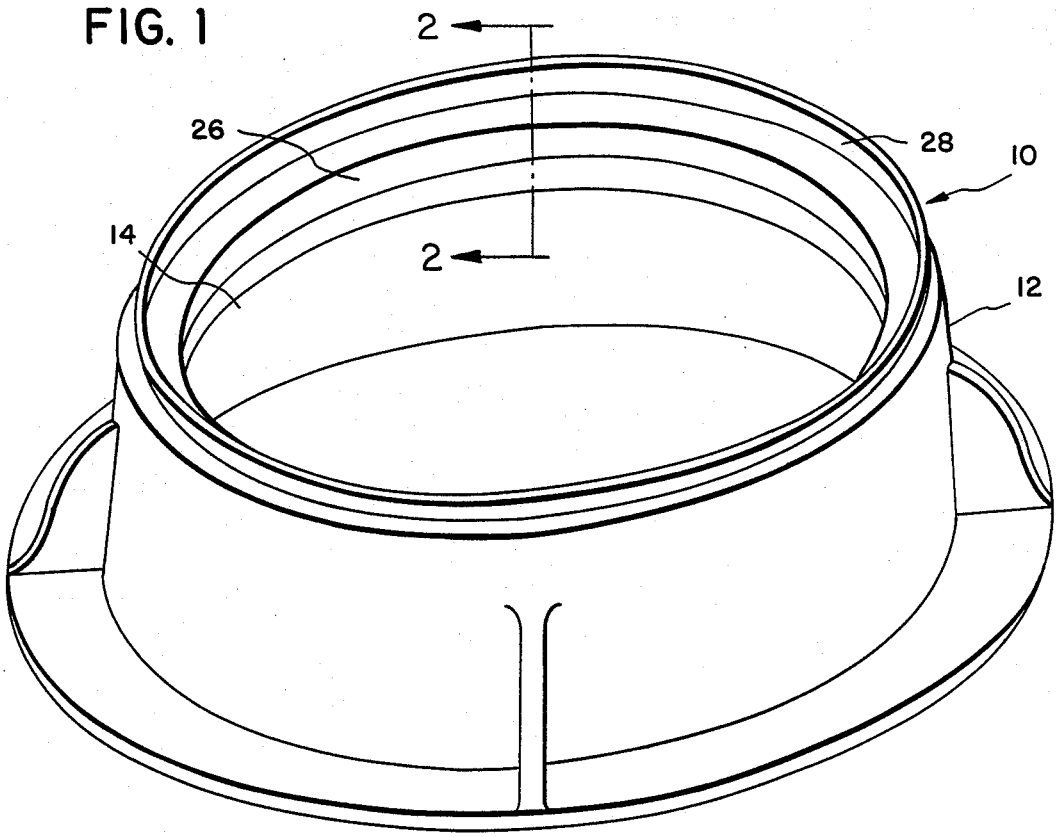
FIG. 1 is a perspective view of one embodiment of a cover extension of this invention assembled for use in the top of a utility housing.

Referring now more specifically to the drawings, a utility cover extension 10 embodying the features of the present invention is shown in FIGS. 1–4. The utility cover extension 10 is provided for insertion into a utility housing 12 having an access opening 14 therethrough. The utility cover extension 10 is provided for vertically adjusting to a new grade the level of the utility cover 16 over the access opening 14 of the housing 12. The access opening 14 includes a support flange 18 with an upwardly sloping peripheral surface 20 extending therefrom. The utility cover 16 has a bottom 22 and an outer peripheral surface 24 extending therefrom.

Figure 2:
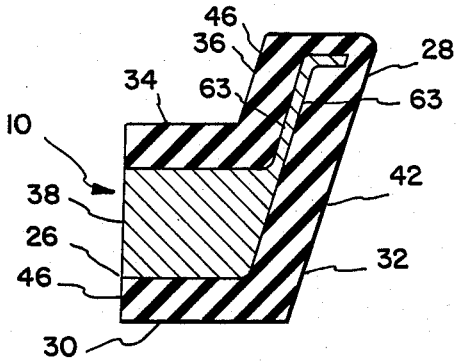
FIG. 2 is a cross-sectional view of the utility cover extension shown in FIG. 1 and taken along line 2—2 of FIG. 1 when the cover is in an unassembled condition.
Figure 3:
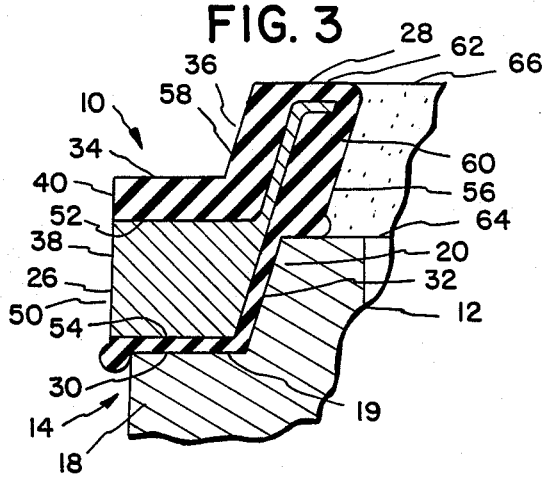
FIG. 3 is a fragmentary sectional view of the cover extension and housing shown in FIG. 1 and taken along line 2—2 of FIG. 1.
Figure 4:
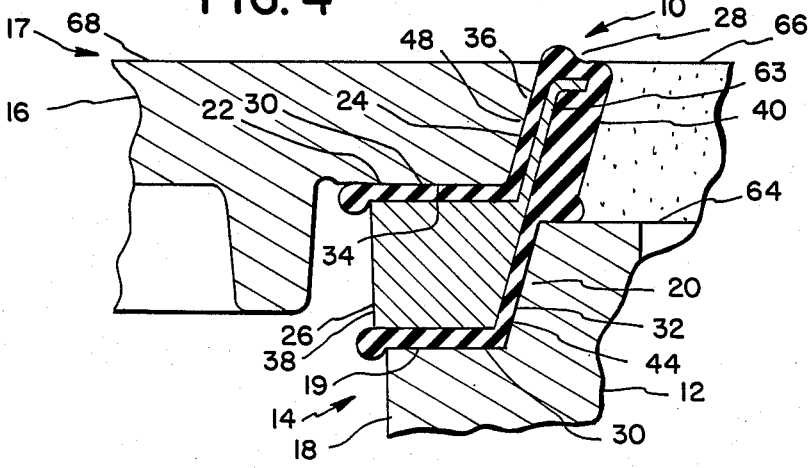
FIG. 4 is sectional view of the cover extension and housing taken line 2—2 of FIG. 1 with a cover assembled therewith.

The extension 10 has an unassembled condition shown in FIG. 2 and an assembled condition shown in FIG. 4. In the assembled condition, the extension 10, housing 12, and cover 16 form the utility cover extension assembly 17 as shown in FIG. 4.

The utility cover extension 10 has a bottom portion 26 and an upper portion 28. The bottom portion 26 has a bottom support surface 30 positionable adjacent the support flange 18 of the utility housing 12 and a bottom outer peripheral surface 32 extending upwardly from the bottom support surface 30. In the assembled condition, the outer peripheral surface 32 of the extension 10 is positioned adjacent to and is complimentary with the peripheral surface 20 of the housing 12. The support flange 18 includes a bottom surface 19 on which the bottom support surface 30 of the extension 10 rests.

The upper portion 28 of the extension 10 is provided for receiving the utility cover 16 therein. The upper portion 28 includes an upper support surface 34 which, when in the assembled condition, is adjacent to the bottom 22 of the cover 16 and supports the cover thereon. The upper portion 28 has an upper inner peripheral surface 36 extending upwardly from the support surface 34. The peripheral surface 36 is positionable adjacent to and complimentary with the outer peripheral surface 24 of the cover 16 when in the assembled condition. For ease of description, the inner peripheral surface 20 of the housing 12 and adjacent outer peripheral surface 32 of the bottom portion 26 of the cover extension 10 will be referred to as complimentary peripheral surfaces and the outer peripheral surface 24 of the cover 16 and adjacent inner peripheral surface 36 of the upper portion 28 of the cover extension 10 will be referred to as complimentary peripheral surfaces.

The extension 10 includes an extension frame 38 and a compressible material 40 forming the bottom and upper support surfaces 30, 34 respectively and the bottom and upper peripheral surfaces 32, 36 respectively. When in the unassembled condition, the circumference 42 of the bottom outer peripheral surface 32 of the extension 10 is greater than the circumference 44 of the peripheral surface 20 of the housing 12. Also, when in the unassembled condition, the circumference 46 of the upper peripheral surface 36 of the extension 10 is greater than the circumference 48 of the outer peripheral surface 24 of the cover 16. Accordingly, an interference fit between the complimentary peripheral surfaces 20, 32 and the complimentary peripheral surfaces 24, 36 exists in the unassembled condition.

When in the assembled condition, the compressible material 40 is compressed so that the circumference of the peripheral surfaces 32, 36 of the extension 10 conform to and are substantially equal to the circumferences 44, 48 of the peripheral surfaces 20, 24 respectively. The compressible material 40 in the assembled condition provides for frictional engagement between the complimentary parts 10 and 12 and the complimentary parts 10 and 16 of the utility cover extension assembly 17 The support surfaces 30, 34 are also compressed in an assembled condition.

The outer peripheral surface 24 of the cover defines an obtuse angle of from between 91 degrees to 110 degrees with the plane of the bottom surface 22 of the cover 16. Likewise, the outwardly sloping peripheral surface 20 of the housing 12 forms an obtuse angle of from between 91 degrees and 110 degrees with the plane of the bottom surface 19 from which the peripheral surface 20 extends. By providing the obtuse angles between the peripheral surface 12 and bottom 22 of the cover 16 and the peripheral surface 20 and bottom surface 19 of the housing 12, the extension 10 may be more readily assembled with the housing and cover 12, 16 respectively. This angular relationship provides for advantageous assembly of the extension 10, housing 12, and cover 16 by providing a camming action to compress the material 40 as the components 10, 12 and 16 are assembled as will be hereinafter described. It should be understood that the term circumference as used in connection with angular peripheral surfaces is the circumference at any particular point along the angular surface.

The compressible material 40 extends continuously about the entire circumferences 42, 46 of the peripheral surfaces 32, 36 of the extension 10 and continuously about the bottom and upper support surfaces 30, 34 of the extension 10. When the compressible material is compressed, a seal is created between the complimentary parts 10, 12, and the complimentary parts 10, 16 of the utility cover extension assembly 17 to resist the flow of surface water and other contaminants through the complimentary surfaces 24, 36, and 22, 34 and 20, 32 and 19, 30.

In the embodiment of the utility cover extension 10 shown in FIGS. 1–4, the utility cover extension 10 includes an extension frame 38 and a compressible material 40 secured to the frame. The compressible material may be selected from a wide variety of both natural and synthetic materials having the properties of compressibility, flexibility, density, elongation, toughness, and impermeability necessary to meet the service conditions described above. The desired characteristics of such a compressible material when used as described by the present invention increases and maintains the frictional forces maintaining the components of the utility cover extension assembly 17 in an assembled relationship, absorbs impact loadings, resists the flow of surface liquids and contaminants through the complimentary surfaces of the utility cover extension assembly 17, decreases the noise level of the extension assembly under operating service conditions, is able to operate under various temperature conditions and in various chemical environments and extends the effective service life of the utility cover extension assembly 17. A wide variety of materials of both natural and synthetic origins and combinations thereof meet these requisites. For example, rubber and plastic materials may be used along with combinations of materials such as cork fillers bonded together with resinous, protein or synthetic binders.

In order to achieve the sealing properties of the present invention the material 40 has the characteristic of impermeability to water. This characteristic can be obtained by using a closed cell elastomer or flexible plastic of the appropriate density and compressibility. Preferred materials for use as the compressible material 40 are cast microcellular urethane elastomers, polyurethane foams, rubber, and plastics if properly formulated and processed. Some examples are: polyisoprene, both natural and synthetic, styrene butadiene, polybutadiene, butyl rubber, chlorobutyl rubber, neoprene, ethylene propylene rubber, nitrile, polyacrylate rubber, polysulfide, silicone elastomers, flouroelastomers, polyethylene acrylate, polyvinyl acetate, epichlorohydrin, chlorosulfonated plyethylene, crosslinked polyethylene, polyethylene, polypropylene, plasticized polyvinyl chloride, polyvinilidene chloride, ionomer, thermoplastic polyester, and polyurethane gum rubber.

One preferred material is Uniroyal, Inc.'s "ADIPRENE" #L167, a polyurethane foam rubber further described by a formula recipe:

100 parts—L-167
0.3 parts—Water
0.3 parts—"DABCO-33LV"
1.4 parts—"DC-193"
16.0 parts—"BC"

These additives are furnished as follows:

DABCO-33LV: Air Products Inc., Allentown, Pa.
DC-193: Dow-Corning Inc., Midland, Mich.
BC: Palmer, Davis, Sieka Inc., Port Washington, N.Y.

The extension frame 38 of the present invention includes a base 56 having a top and a bottom surface 52, 54 respectively, with a lateral support portion 56 extending upwardly from the top surface 52 and terminating in a flange 62. The lateral support portion 56 has an inside surface 58 and the lateral support portion 56 and the outer portion of the base 50 has an outside surface 60.

In the embodiment described in FIGS. 1–4, the material 40 extends around the surfaces 52, 54, 58, 60 and the flange 62 and is bonded thereto. The frame 38 provides structural rigidity to the extension 10 and the strength to operate in the service conditions described above.

Means are provided to bond the compressible material 40 to the surfaces 52, 54, 58, 60 and flange 62. For example, a permanent adhesion of the cured "ADIPRENE" polyurethane foam rubber is accomplished by a chemical and mechanical bonding process by using the bonding agent 63 "CHEMLOK" #218 as manufactured by the Lord Corporation, Erie, Pa. The metal surfaces 52, 54, 58, 60, 62 of the extension frame 38 are thoroughly cleaned. The bonding agent 63 is then applied to the surfaces 52, 54, 58, 60, 62 of the extension frame 38 and allowed to dry The material 40 is then applied o the surfaces 52, 54, 58, 60, 62 in an elevated temperature environment. This chemical bonding procedure is further described in the product information catalog BS10-2026J of the Lord Corporation, Erie, Pa.

It is also within the contemplation of this invention to manufacture the compressible material 40 by molding, extruding or casting using the proper adhesive or bonding agent to attach or bond and secure the compressible material to the extension frame 38.

The present invention also provides methods to achieve the desirable features of the present invention. One such method includes cutting strips of the compressible material 40 out of a sheet with the proper dimensions and of sufficient length to go around the circumference of the bottom surface 54 and the outside surface 60 terminating underneath the flange 62. Alternatively, this strip of material may be cut sufficiently large to extend all the way around the extension frame 38 to form a continuous surface therearound which is necessary to achieve the desirable sealing characteristics. The strip of compressible material is then secured to the bottom surface and outside surface 54, 60 respectively by any conventional known means particularly suited to the compressible material selected, such as an adhesive molding in place by heat and pressure using a bonding agent and the like.

It should be understood that if it is necessary to only achieve the frictional and load absorbing characteristics of the present invention, strips of compressible material 40 may be placed along only portions of the outside surface 60 and bottom surface 54 to cushion the vertical impact energy loadings on the utility cover extension 10 and maintain the frictional relationship between the components of the assembly.

This method also includes cutting another strip of material 40 of the proper dimension to fit on the top surface 52 and inside surface 58 of the extension frame 38. This compressible material 40 is secured to the frame 38 in a manner similar to that described above in connection with the method of securing the compressible material to the bottom and outside surfaces 54, 60 respectively of the frame 38.

Another method of achieving the desirable features of the present invention is to form the compressible material 40 by molding the material into its desired shape. The molded material is then positioned about the extension frame 38 and bonded thereto by any means suited for the particular material of the frame 38 and the type of compressible material 40 used. One example is described above in connection with "ADIPRENE" used as the compressible material and "CHEMLOK" used as the bonding agent.

Yet another method to achieve the desirable features of the present invention is to position the extension frame 38 in the cavity of a mold, and mold the compressible material 40 about the extension frame after treating the frame with a bonding agent thereby accomplishing the bonding process simultaneously.

Various advantages and features of the molding process can be used to achieve various physical characteristics of material, such as a multiple layer material as described in connection with the embodiment disclosed in FIGS. 9–11.

While the above description includes bonding the compressible material 40 to the extension frame 38, it should be understood that it is within the contemplation of this invention to bond the compressible material to the surfaces 19, 20 of the housing 12 and surfaces 22, 24 of the cover 16 to obtain the desirable features of the present invention.

When it is desirable to repair or resurface a roadway, it becomes necessary for the original grade 64 of the roadway to be raised to a new grade or level 66. To raise the utility cover 16 so that the top 68 of the cover 16 is at the new grade 66, the cover 16 is removed from its seated position in the utility housing. The utility cover extension is positioned over the access opening 14 of the housing 12. The utility cover extension 10 is then moved down the outwardly sloping peripheral surface 20 and the compressible material 40 forming the bottom outer peripheral surface 32 is compressed as the extension moves in a downward direction. Since the peripheral surface 20 of the housing 12 is outwardly sloping, the peripheral surface 20 has a camming action to urge the compressible material 40 forming the peripheral surface 32 into a compressed condition.

As the extension 10 continues to move in a downward direction, the compressible material 40 forming the bottom support surface 30 contacts the bottom surface 19 of the flange 18 of the housing 12. Further downward movement of the extension 10 compresses the compressible material forming the bottom support surface 30 of the extension. In this position, the extension 10 is in the condition shown in FIG. 3 with the material 40 forming the bottom support surface 30 and bottom outer peripheral surface 32 being in a compressed condition.

After repairing or repaving the roadway to the new grade 66, the cover 16 is inserted into the extension 10.

The outer peripheral surface 24 of the cover 16 is of a similar configuration to the peripheral surface 20 of the housing 12. The outer peripheral surface 24 of the cover 16 comes into contact with the inner peripheral surface 36 of the extension 10 and as the cover is moved in a downward position, the compressible material 40 forming the inner peripheral surface is compressed. The bottom surface 22 of the cover 16 comes into contact with the upper support surface 34 of the extension 10 as continued downward movement of the cover occurs. Further downward movement of the cover 16 compresses the compressible material 40 forming the upper support surface 34. In this assembled condition, the top 68 of the cover 16 is level with the new grade.

Accordingly, when assembled, the bottom outer peripheral surface 32 of the extension 10 defines an obtuse angle of from between 91 degrees and 110 degrees with the plane of the bottom support surface 30 and the upper inner peripheral surface 36 forms an obtuse angle of from between 91 degrees and 110 degrees with the plane of the upper support surface 34 from which the inner peripheral surface 36 extends. Even if the complimentary surfaces 19, 22 and 20, 24, respectively are worn, the compressible material provides sufficient flexibility to allow the same components to be used without requiring a new cover while still providing the advantageous features of the present invention.

The embodiments of the present invention shown in the drawings provide an extension frame 38 with the surfaces 58, 60 formed at an obtuse angle. This obtuse angle is the same as the obtuse angle of the peripheral surfaces 20, 24 of the housing 12 and cover 16, respectively. It should be understood that it is within the contemplation of this invention to form the surfaces 58, 60 at other angles, for example, at a 90 degree angle. In such a design, the extension frame may be more easily formed and the compressible material 40 is positioned between the extension frame 38 and the housing 12 and cover 16 to provide the advantageous features of the present invention.

The embodiments of the present invention shown in the drawings also describe the peripheral surfaces 32, 36 of the compressible material 40 of the extension 10 when in an unassembled condition formed at the obtuse angle of the peripheral surfaces 20, 24 of the housing 12 and cover 16, respectively. It should be understood that it is within the contemplation of this invention to form the peripheral surfaces 32, 36 at other angles when in an unassembled condition, for example, at a 90 degree angle. When such a utility cover extension is assembled with the housing 12 and cover 16, the compressible material 40 deforms to the obtuse angle of the peripheral surfaces 20, 24 of the housing 12 and cover 16, respectively, and provides the desirable features of the present invention.

In operation, the compressible material 40 absorbs the impact energy exerted under normal service conditions and dissipates that impact energy. It is believed that the compressible material 40 cold flows into the asperities on the surfaces 22, 24 of the cover 16 and surfaces 19, 20 of the housing 12 to create a bonding therebetween. Thus, when an impact loading occurs, the compressible material flexes and absorbs the energy without creating any wear between the metal components. By so securing the components of the extension assembly 17 in an assembled condition, relative movement between the components is resisted.

The compressible material 40 when so compressed operates as a seal between the extension 10 and housing 12 and also a seal between the extension 10 and the cover 16 to thereby resist the flow of surface water and other contaminants into the access opening 14 of the utility housing.

The compressible material 40, when in an assembled condition reduces the noise generated under normal service conditions, for example, reducing the noise generated by vehicles passing over and impacting the cover 16.

Utility cover assembly 10 of the present invention may have a wide variety of constructions, designs and geometric configurations. The terms "circumference" and "peripheral surface", both singular and plural, as used in this application, apply to not only circular configurations but also to a wide variety of geometric configurations. For example, the circumferences and peripheral surfaces of the utility cover extension 10 may be round, square, rectangular, or triangular or any other geometric configuration depending on the shape of the utility housing 12 and cover 16. For example, manhole cover extensions may be of generally round, square or rectangular shapes and valve covers and meters may be round, square, rectangular or triangular and in other cases take on other geometric configurations. It should be understood that the present invention may be embodied in any such geometric configurations.

The specific utility cover extension construction shown in FIGS. 1–4 should be considered as primarily illustrative. Other constructions are illustrated in FIGS. 5–14. For ease of description, these other constructions are numbered with numerals the same as those used in FIGS. 1–4 to denote common parts, where appropriate, followed by a suffix letter to denote each specific embodiment. For example, the common parts of the construction shown in FIGS. 5–8 will be followed by the suffix "a", the common parts of the construction shown in FIGS. 9–11 by the suffix "b", and the common parts of the construction shown in FIGS. 12–14 by the suffix "c".

Figure 5A:
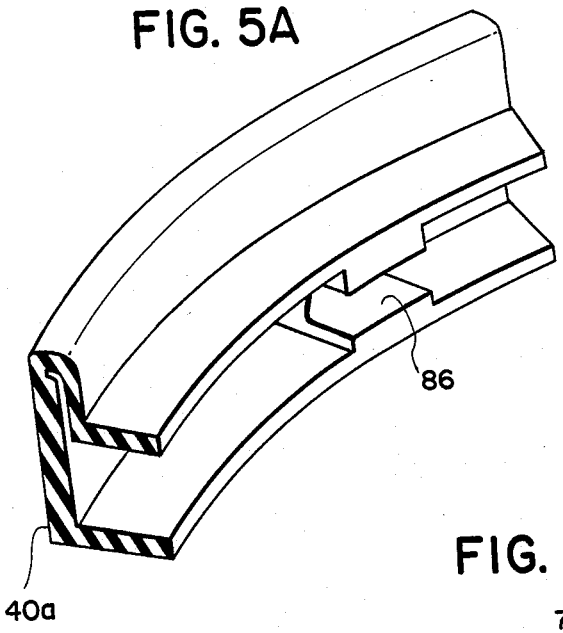
FIG. 5 is an exploded perspective view of another embodiment of a cover extension of the present invention mounted in a utility cover housing.
Figure 5B:
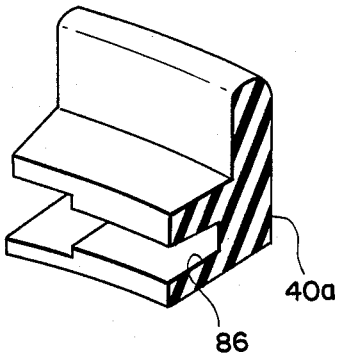
Figure 5C:
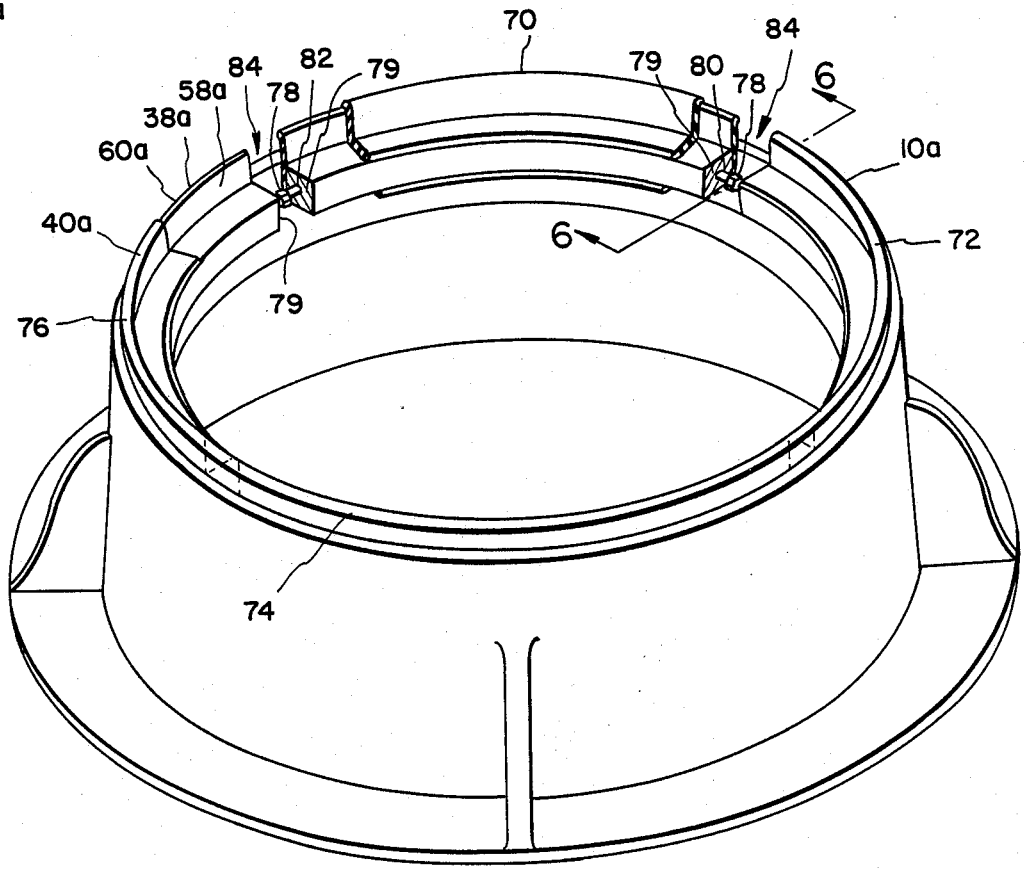

The utility cover extension 10a shown in FIG. 5 has an extension frame **38*a* with a compressible material 40*a*. The extension frame 38*a* is similar in construction with the extension frame 38 except that the extension frame 38*a* is formed of a plurality of peripheral segments 70, 72, 74, and 76 joined by a suitable attaching means such as the bolts 78**. Such a design is further shown in applicant's U.S. Pat. No. 3,773,428.

The ends 79 of the peripheral segments, 70, 72, 74, and 76 have threaded openings 80, 82 in the opposing ends thereof. The threaded opening 80 is threaded in one direction with the threaded opening 82 being threaded in the opposite direction. The bolts 78 have complimentary threads therein so that when the bolts are rotated in one direction, the circumferences of the surfaces **58*a*, 60*a* increase and when the bolts 78 are rotated in the other direction, the circumferences of the surfaces 58*a*, 60*a* are decreased. The compressible material 40*a* mounted on the extension frame 38*a* is cross-sectionally similar to that described in connection with the embodiment described in FIGS. 1–4 except for the spaces 84 between the ends 79 of the segments 70, 72, 74 and 76**.

FIG. 5 is an exploded sectional perspective view of the extension **10*a* and housing 12*a* and shows the utility cover extension 10*a* with portions of the compressible material 40***a* in the area of the openings or spaces 84 between the ends 79 of the segments 70, 72, 74, and 76.

Figure 8:
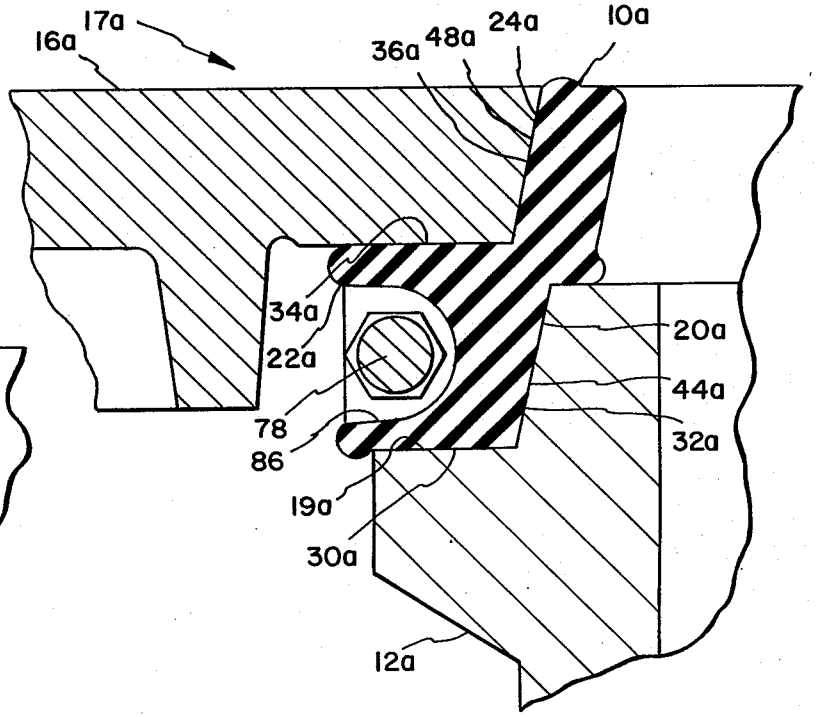
FIG. 8 is a sectional view of the extension and housing shown in FIG. 7 with a cover assembled therewith.
Figure 7:
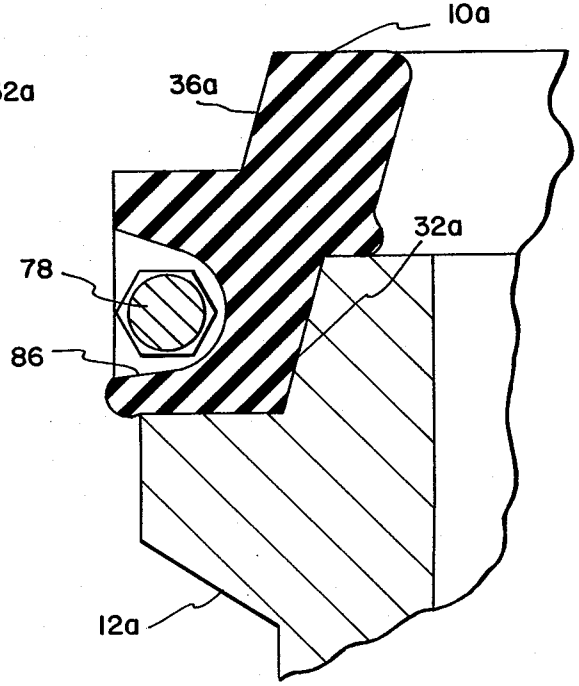
FIG. 7 is a cross-sectional view of the cover extension and housing shown in FIG. 5 in assembled condition taken along line 6—6 thereof.
Figure 6:
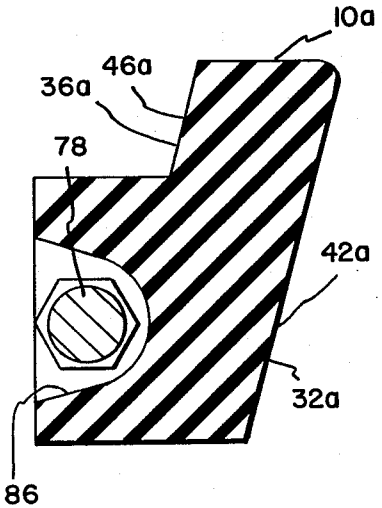
FIG. 6 is a sectional view of the cover extension shown in FIG. 5 and taken along line 6—6 thereof in an unmounted condition.

To provide the advantageous sealing feature provided by the present invention, the compressible material 40*a* in the areas between the spaces 84 must be reinforced so that a seal is effected between the components 10*a*, 12*a*, and 16*a* of the utility cover extension assembly 17*a* shown in FIG. 8. As shown in FIG. 6, in an unassembled condition, the compressible material 40*a* does not have a portion of the extension 38*a* extending therethrough in the area of the space 84. It should be understood that extension frames of other constructions and designs may be utilized which allow for telescopic portions of the extension frame 38*a* to allow for improved rigidity of the extension 10*a* when moved between a contracted and assembled position.

The compressible material 40*a* in the area between the space 84 extends between the surfaces 30*a*, 32*a*, 34*a*, and 36*a* of the extension 10*a* with a cut out 86 between the surfaces 30*a*, 34*a* which allows space for the bolt 78 for insertion of a wrench or the like to rotate the bolt. This additional material creates rigidity and strength to provide the sealing characteristics between the extension 10*a*, housing 12*a*, and utility cover 16*a* described above in connection with the utility cover extension assembly 17.

Preferably, the compressible material 40*a* is molded to provide he reinforced sections 85. The compressible material 40*a* is molded in a separate mold and assembled with the extension frame 38 with a bonding agent between the extension frame and the compressible material 40*a*. The molding process may also be accomplished by directly molding the material 40*a* to the extension frame 38*a*. Other known methods, such as extrusions, may be used with rubber inserts to provide the reinforced sections 85.

In the unassembled condition shown in FIG. 6, the circumference 46*a* of the extension 10*a* is greater than the circumference 44*a* of the housing 12*a* and the circumference 42*a* of the extension is less than the circumference 48*a* of the utility cover 16*a*. It should be understood for purposes of describing the extension 10*a* in the assembled and unassembled condition, the circumference of the surfaces 58*a*, 60*a* of the extension frame 38*a* shown in FIG. 5, are the same in both the unassembled condition and assembled condition, but in order to move between the assembled and unassembled condition, the bolts 78 are advantageously rotated to allow for more ready assembly of the components of the utility cover extension assembly 17*a*.

To assemble the utility cover extension 10*a* to the utility housing 12*a*, the bolts 78 are rotated to decrease the circumferences of the surfaces 58*a*, 60*a* of the extension frame 38*a*. As the circumference of the extension frame 38*a* is so decreased, the spaces 84 between the ends 79 of the segments 70, 72, 74, and 76 decrease and the reinforced sections 85 of the compressible material 40*a* are accordingly compressed. In addition, the circumferences of the outside surface 60*a* of the frame 38*a* and correspondingly the circumference of the peripheral surface 32*a*, 36*a* is decreased.

When the utility cover 10*a* is positioned in this contracted position, the utility cover extension 10*a* may be more readily positioned in the utility housing 12*a*. When the extension 10*a* is positioned in the housing 12*a* the compressible material 40*a* forming the bottom support surface 30*a* is compressed. After compression of the material 40*a* forming the bottom support surface 30*a* and outer peripheral surface 32*a* when positioned in the housing 12*a*, the bolts 78 are rotated in a direction which provides for the expansion of the extension frame 38*a* to an assembled position. As the extension frame 38*a* is moved to its assembled position, the bottom outer peripheral surface 32*a* is compressed. When in the assembled condition, the cover 16*a* is assembled with the extension 10*a* in a manner as described above in connection with the embodiment shown in FIGS. 1–4 and the components 10*a*, 12*a*, and 16*a* are in an assembled relationship as shown in FIG. 8.

Over the short span of the reinforced sections 85, an effective seal between the complimentary surfaces 22*a*, 34*a* and 24*a*, 36*a* of the cover 16*a* and extension 10*a* respectively is created. Likewise, a seal is provided between the complimentary surfaces 19*a*, 30*a* and complimentary peripheral surfaces 20*a*, 32*a* of the housing 12*a* and extension 10*a* respectively.

Figure 11:
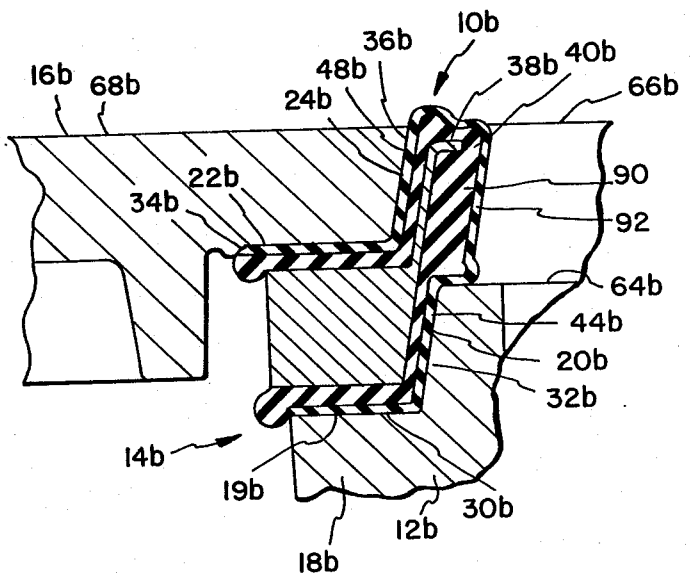
FIG. 11 is a cross-sectional view of the cover extension shown in FIG. 10 when assembled with a cover.
Figure 10:
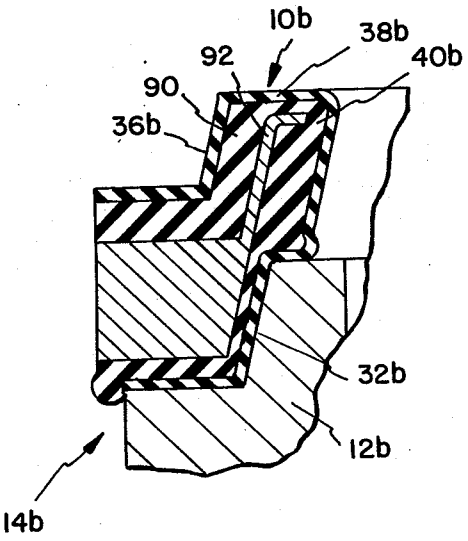
FIG. 10 is a cross-sectional view cover extension shown in FIG. 9 when assembled with a housing.
Figure 9:
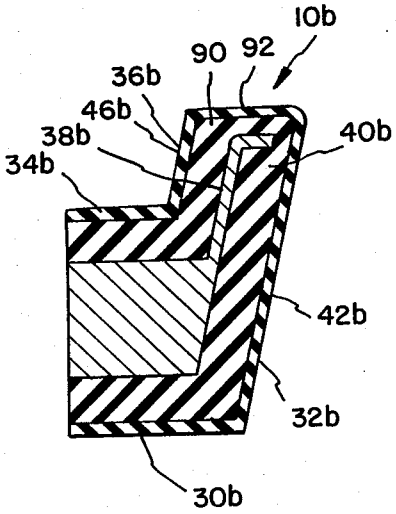
FIG. 9 is a sectional view of yet another embodiment of the cover extension of the present invention when in an unassembled condition.

The utility cover extension 10b shown in FIGS. 9–11 has an extension frame 38*b* with a compressible material 40*b*. The compressible material 40*b* has an inner layer 90 and an outer layer 92 that are bonded together. The inner layer 90 is bonded to the extension frame 38*b* as described above in connection with the extension frame 38 and compressible material 40. The outer layer 92 is formed from a flexible wear resistent material and describes the peripheral surfaces 32*b*, 36*b* and support surfaces 30*b*, 34*b* of the extension 10*b*. The outer layer 92 is selected for its wear resistent qualities and is bonded to the inner layer 90.

The outer layer 92 has cold flow characteristics wherein the material flows into the asperities on the surfaces 22*b*, 24*b* of the cover 16*b* and the surfaces 19*b*, 20*b* of the housing 12*b* to create an mechanical bond therewith.

When in the unassembled condition, the circumference 42*b* of the bottom outer peripheral surface 32*b* of the extension 10*b* is greater than the circumference 44*b* of the peripheral surface 20*b* of the housing 12*b*. Also, when in the unassembled condition, the circumference 46*b* of the upper peripheral surface 36*b* of the extension 10*b* is greater than the circumference 48*b* of the outer peripheral surface 24*b* of the cover 16*b*. Accordingly, an interference fit between the complimentary peripheral surfaces 20*b*, 32*b* and the complimentary peripheral surfaces 24*b*, 36*b* exists in the unassembled condition.

When in the assembled condition, the compressible material 40*b* is compressed so that the circumference of the peripheral surfaces 32*b*, 36*b* of the extension 10*b* conform to and are substantially equal to the circumferences 44*b*, 48*b* of the peripheral surfaces 20*b*, 24*b* respectively. The compressible material 40*b* in the assembled condition provides for frictional engagement between the complimentary parts 10*b* and 12*b* and the complimentary parts 10*b* and 16*b* of the utility cover extension assembly 17*b*.

The compressible material 40*b* extends continuously about the entire circumferences 42*b*, 46*b* of the peripheral surfaces 32*b*, 36*b* of the extension 10*b* and continuously about the bottom and upper support surfaces 30*b*, 34*b* of the extension 10*b*. When the compressible material is compressed, a seal is created between the complimentary parts 10*b*, 12*b*, and the complimentary parts 10*b*, 16*b* of the cover extension assembly 17*b* to resist the flow of surface water and other contaminants through the complimentary surfaces 24*b*, 36*b*, and 22*b*, 34*b* and 20*b*, 32*b* and 19*b*, 30*b*.

When it is desirable to repair or resurface a roadway, it becomes necessary for the original grade 64b of the roadway to be raised to a new grade or level 66b. To raise the utility cover 16b so that the top 68b of the cover 16b is at the new grade 66b, the cover 16b is removed from its seated position in the utility housing. The utility cover extension 10b is positioned over the access opening 14b of the housing 12b. The utility cover extension 10b is then moved down the outwardly sloping peripheral surface 20b and the compressible material 40b forming the bottom outer peripheral surface 32b is compressed as the extension moves in a downward direction. Since the peripheral surface 20b of the housing 12b is outwardly sloping, the peripheral surface 20b has a camming action to urge the compressible material 40b forming the peripheral surface 32b into a compressed condition. During this assembly, the outer layer 92 resists damage by any abrasion caused by this assembly process.

As the extension 10b continues to move in a downward direction, the compressible material 40b forming the bottom support surface 30b contacts the bottom surface 19b of the flange 18b of the housing 12b. Further downward movement of the extension 10b compresses the compressible material forming the bottom support surface 30b of the extension. In this position, the extension 10b is in the condition shown in FIG. 3 with the material 40b forming the bottom support surface 30b and bottom outer peripheral surface 32b being in a compressed condition.

After repairing or repaving the roadway to the new grade 66b, the cover 16b is inserted into the extension 10b. The outer peripheral surface 24b of the cover 16b is of a similar configuration to the peripheral surface 20b of the housing 12b. The outer peripheral surface 24b of the cover 16b comes into contact with the inner peripheral surface 36b of the extension 10b and as the cover is moved in a downward position, the compressible material 40b forming the inner peripheral surface is compressed. The bottom surface 22b of the cover 16b comes into contact with the upper support surface 34b of the extension 10b as continued downward movement of the cover occurs. Further downward movement of the cover 16b compresses the compressible material 40b forming the upper support surface 34b. During assembly, the outer layer 92 slides across the cover 16 and resists abrasion thereof. In this assembled condition, the top 68b of the cover 16b is level with the new grade.

In operation, the compressible material 40b absorbs the impact energy exerted under normal service conditions and dissipates that impact energy. It is believed that the compressible material 40b of the outer layer 92 cold flows into the asperities on the surfaces 22b, 24b of the cover 16b and surfaces 19b, 20b of the housing 12b to create a bonding therebetween Thus, when an impact loading occurs, the compressible material flexes and absorbs the energy without creating any wear between the metal components. By so securing the components of the extension assembly 17b in an assembled condition, relative movement between the components is resisted.

The wear resistent properties of the outer layer 92 provide for maintaining seal between the complimentary surfaces 30b, 19b and 32b, 20b of the extension 10b and housing 12b, respectively, and the complimentary surfaces 34b, 22b and 36b, 22b of the extension 10b and cover 16b, respectively.

Figure 14:
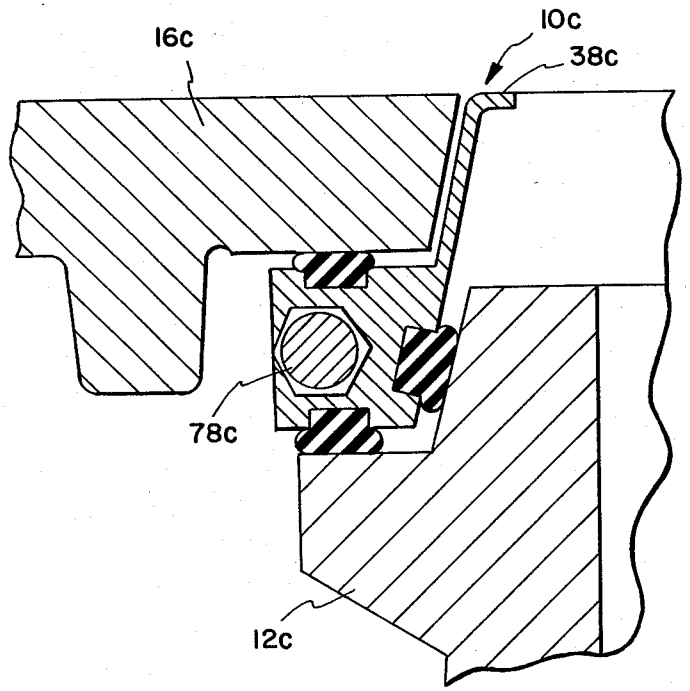
FIG. 14 is a cross-sectional view of the cover extension shown in FIG. 13 taken through the adjustable portion of the cover extension.
Figure 13:
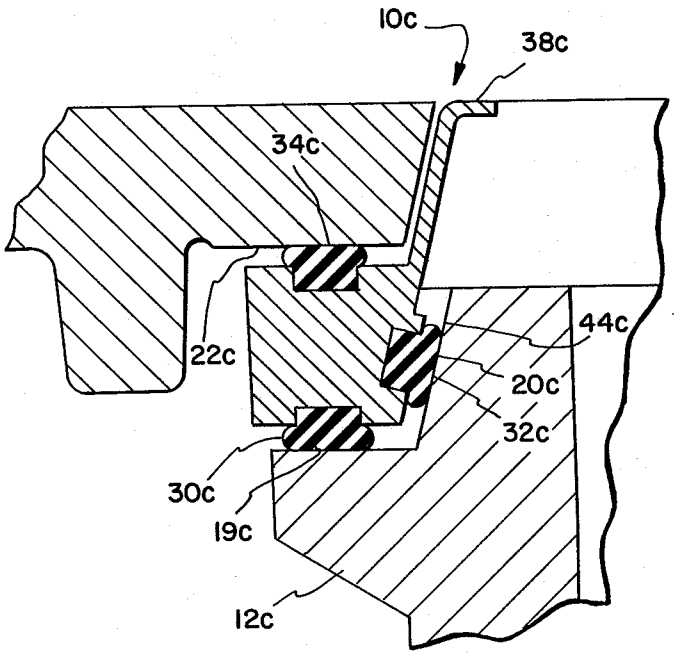
FIG. 13 is a cross-sectional view of the cover extension shown in FIG. 12 when assembled with a utility housing and cover.
Figure 12:
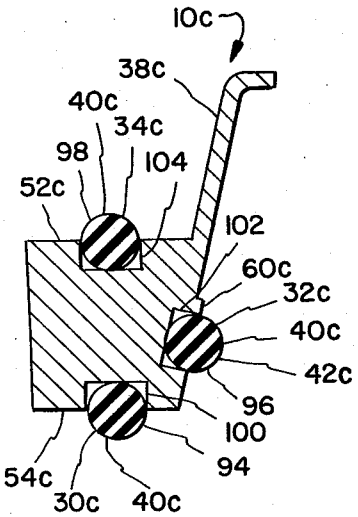
FIG 12 is a sectional view of a further embodiment of the cover extension of the present invention when in an unassembled condition.

The utility cover extension 10c shown in FIGS. 12–14 has an extension frame 38c with a compressible material 40c. The extension frame 38c is similar to the construction of the extension frame 38a which provides for adjustment of the circumference of the extension 38c by means of the bolts 78c. The compressible material 40c is formed in the shape of rings 94, 96, 98.

Means are provided to secure the rings 94, 96, 98 to the surfaces 52c, 54c, 60c of the extension frame 38a. The rings 94, 96, 98 are fitted into the slots 100, 102 and 104 and extend about the circumferences thereof to form a part of the surfaces 30c, 32c, 34c of the extension 10c.

When in the unassembled condition, the circumference 42c of the bottom outer peripheral surface 32c of the extension 10c formed by the ring 96 is greater than the circumference 44c of the peripheral surface 20c of the housing 12c. Accordingly, there is an interference fit between the complimentary peripheral surfaces 20c, 32c.

When in the assembled condition, the compressible material 40c is compressed so that the circumference of the peripheral surface 32c of the extension 10c conform to and are substantially equal to the circumferences 44c of the peripheral surfaces 20c. The compressible material 40c in the assembled condition provides for frictional engagement between the complimentary parts 10c and 12c and the complimentary parts 10c and 16c of the utility cover extension assembly 17c. The support surfaces 30c, 34c are also compressed in an assembled condition.

The compressible material 40c extends continuously about the entire circumferences 42c of the peripheral surface 32c, of and continuously about the bottom and upper support surfaces 30c, 34c of the extension 10c. When the compressible material is compressed, a seal is created between the complimentary parts 10c, 12c, and the complimentary parts 10c, 16c of the utility cover extension assembly 17c to resist the flow of surface water and other contaminants through the complimentary surfaces 22c, 34c and 20c, 32c and 19c, 30c.

In operation, the compressible material 40c absorbs the impact energy exerted under normal service conditions and dissipates that impact energy and also provides a seal about the complimentary peripheral surfaces. Accordingly, the engagement between the utility housing 12c and extension 10c is maintained under normal service conditions.

Having described my invention, I claim:

1. A utility cover extension for paving work, said extension being expandable to fit into a utility housing that itself forms a first access opening and possesses a support flange and a retainer which are disposed to support and laterally retain a manhole cover over said first access opening, the utility cover extension being adapted to rest on the support flange of the housing and provide a higher access opening at a new raised elevation that is suitable for pavement resurfacing, the extension having a rim for lateral retention of a manhole cover, a seat with a bearing surface for a manhole cover at the new raised elevation, and at least one spreadable joint that can be expanded to leave a gap in the seat with concomitant forcing of the outside of the extension against the retainer of the housing, the extension being further characterized by having a descrete closure for said gap comprising a compressible polymer, said closure being effective for preventing the substantial infiltration of surface water through the gap.

2. The utility cover extension of claim 1 wherein at least a portion of the bearing surface of said seat constitutes or sustains a deformable water seal immediately beneath the underside periphery of the manhole cover.

3. In a process for raising the grade of a manhole cover in a pavement to a new grade that is suitable for resurfacing of the pavement by the installation of a utility cover extension that rests on the support flange of a utility housing and is retained therein by a retainer, makes a snug fit therein and provides a new access opening thereabove, the extension providing lateral retention of and a seat for a manhole cover, the extension having at least one spreadable joint that is expanded to leave a gap in the seat when the outside of the extension is forced against the retainer of the housing, the improvement which comprises: applying at said gap a closure comprising compressible polymer that is effective for sealing the gap against the substantial infiltration of surface water.

4. The process of claim 3 wherein at least a portion of the bearing surface of said seat constitutes or sustains a deformable water seal immediately beneath the underside periphery of the manhole cover.

* * * * *